US010738787B2

(12) United States Patent
Dybenko et al.

(10) Patent No.: US 10,738,787 B2
(45) Date of Patent: Aug. 11, 2020

(54) SHROUDED FAN IMPELLER WITH REDUCED COVER OVERLAP

(71) Applicant: Apple Inc., Cupertino, CA (US)

(72) Inventors: Jesse T. Dybenko, Santa Cruz, CA (US); Anthony Joseph Aiello, Santa Cruz, CA (US); Nicholas D. Mancini, San Jose, CA (US); Jay S. Nigen, Los Gatos, CA (US); Arash Naghib Lahouti, San Jose, CA (US)

(73) Assignee: Apple Inc., Cupertino, CA (US)

( * ) Notice: Subject to any disclaimer, the term of this patent is extended or adjusted under 35 U.S.C. 154(b) by 222 days.

(21) Appl. No.: 15/708,989

(22) Filed: Sep. 19, 2017

(65) Prior Publication Data

US 2018/0003183 A1 Jan. 4, 2018

Related U.S. Application Data

(63) Continuation of application No. 14/559,672, filed on Dec. 3, 2014, now Pat. No. 9,765,788.

(60) Provisional application No. 61/911,931, filed on Dec. 4, 2013.

(51) Int. Cl.

| | |
|---|---|
| ***F04D 25/06*** | (2006.01) |
| ***F04D 29/42*** | (2006.01) |
| ***F04D 29/16*** | (2006.01) |

(52) U.S. Cl.

CPC ..... *F04D 25/0613* (2013.01); *F04D 29/162* (2013.01); *F04D 29/4226* (2013.01)

(58) Field of Classification Search

CPC . F04D 25/0613; F04D 29/162; F04D 29/4226
USPC ..... 415/206
See application file for complete search history.

(56) References Cited

U.S. PATENT DOCUMENTS 3,205,828 A * 9/1965 Rupp ..... F04D 29/2205 415/199.1
5,964,576 A * 10/1999 Fujita ..... F04D 29/282 415/206
6,439,843 B1 * 8/2002 Finkenbinder ..... F04D 29/162 415/172.1

(Continued)

FOREIGN PATENT DOCUMENTS

| | | |
|---|---|---|
| CN | 2697361 | 5/2005 |
| CN | 101372987 | 2/2009 |
| CN | 104847692 | 8/2015 |

OTHER PUBLICATIONS

U.S. Appl. No. 14/559,672 , "Non-Final Office Action", dated Jan. 27, 2017, 14 pages.

(Continued)

*Primary Examiner* — David Hamaoui
*Assistant Examiner* — John D Bailey
(74) *Attorney, Agent, or Firm* — Kilpatrick Townsend and Stockton LLP

(57) ABSTRACT

The described embodiments relate to improving efficiency of a low-profile cooling fan. In one embodiment, an impeller of the cooling fan includes a shroud which covers a central portion of the impeller, thereby allowing a central inlet portion of the blades to have an increased fan blade height when compared to a cooling fan constrained by minimum part tolerances between the fan blades and a portion of the fan housing. In some embodiments, the impeller includes splitter blades that can improve performance of the low-profile cooling fan.

20 Claims, 14 Drawing Sheets

(56) References Cited

U.S. PATENT DOCUMENTS 7,670,115 B2 * 3/2010 Cho ..... F04D 29/281 416/186 R
8,007,232 B2 * 8/2011 Hwang ..... F04D 29/281 415/182.1
8,313,282 B1 * 11/2012 Jarrah ..... F04D 13/14 165/104.33
9,765,788 B2 * 9/2017 Dybenko ..... F04D 25/0613
10,118,502 B2 * 11/2018 Yokote ..... H01M 10/625
2003/0161728 A1 * 8/2003 Cho ..... F04D 29/164 415/222
2005/0103042 A1 * 5/2005 Sanagi ..... F04D 25/082 62/419
2009/0053052 A1 * 2/2009 Hwang ..... F04D 29/281 415/203
2009/0196754 A1 * 8/2009 Hwang ..... F04D 29/281 416/223 R
2009/0263232 A1 * 10/2009 Jarrah ..... F04D 25/0613 415/4.4
2009/0263238 A1 * 10/2009 Jarrah ..... F04D 29/544 415/199.5
2010/0003131 A1 * 1/2010 Hwang ..... F04D 25/0613 415/220
2010/0014967 A1 * 1/2010 Blass ..... F01P 11/12 415/220
2010/0220445 A1 * 9/2010 Fujiwara ..... F04D 25/068 361/695
2011/0063799 A1 * 3/2011 Takahasi ..... F04D 25/08 361/695
2011/0091315 A1 * 4/2011 Chang ..... F04D 25/0613 415/182.1
2012/0169160 A1 * 7/2012 Horng ..... F04D 25/0613 310/59
2013/0315724 A1 * 11/2013 Hsiung ..... F04D 25/0613 415/206
2014/0219789 A1 * 8/2014 Horng ..... F04D 29/162 415/206
2015/0152883 A1 * 6/2015 Dybenko ..... F04D 25/0613 415/220
2015/0354585 A1 * 12/2015 Wu ..... H05K 7/20172 415/208.2
2016/0003258 A1 * 1/2016 Wu ..... F04D 25/0613 415/203

OTHER PUBLICATIONS

U.S. Appl. No. 14/559,672 , "Notice of Allowance", dated May 26, 2017, 7 pages.
Chada , "Design of High Efficiency Blowers for Future Aerosol Applications", Texas A&M Univ., Office of Graduate Studies, Dec. 2005, 123 pages.
CN201410727281.0 , "First Office Action", dated Sep. 21, 2016, 10 pages.
CN201410727281.0 , "Second Office Action", dated May 24, 2017, 11 pages.
Notification of the Third Office Action dated Nov. 27, 2017 in Chinese Application No. 2014107272810. 5 pages. (includes English translation).
Notice of Decision to Grant dated Jun. 13, 2018 in Chinese Application No. 2014107272810. 7 pages (includes English translation of the allowed claims).

* cited by examiner

SHROUDED FAN IMPELLER WITH REDUCED COVER OVERLAP

CROSS-REFERENCES TO RELATED APPLICATIONS

This application is a continuation of U.S. application Ser. No. 14/559,672, filed Dec. 3, 2014, which claims priority to U.S. Provisional application Ser. No. 61/911,931, filed Dec. 4, 2013, which is hereby incorporated by reference in its entirety for all purposes.

FIELD

The described embodiments relate generally to fan designs that allow for an overall reduction in height of a fan assembly. More particularly, the present embodiments relate to maintaining an effective blade height of the fan assembly by utilizing a shroud to cover part of a bottom portion of the fan assembly.

BACKGROUND OF THE INVENTION

As computer systems are reduced in thickness, the thickness of the modules and components inside must also be correspondingly reduced. Although these modules and components must get thinner, reduced performance is generally not an acceptable consequence and, hence, new methods are sought to improve performance of these modules. One particular component module that continues to need a relatively substantial amount of vertical height is a fan assembly. Unfortunately, a reduction in height of the fan assembly generally corresponds to a reduced effective blade height of the fan assembly, thereby reducing an effective flow rate of the fan assembly.

Therefore, what is desired is a configuration that allows for a reduction in fan assembly height without reducing the effective flow rate of the reduced height fan assembly.

BRIEF SUMMARY OF THE INVENTION

This paper describes various embodiments that relate to designs for efficient low profile fan assemblies.

According to one embodiment, an impeller enclosed within a cover is described. The impeller includes a central hub and a number of blades extending radially from the central hub. The impeller also includes a ring shaped shroud attached to the blades separated from the cover by a radial gap that allows the ring shaped shroud to rotate with the plurality of blades without contacting the cover. The shroud extends towards the tip of each of the blades, allowing an increase in the effective height of the blades.

According to another embodiment, a fan assembly is disclosed. The fan assembly includes at least the following: a housing; a cover that cooperates with the housing to define a fan assembly interior portion, the cover defining a fan inlet zone external to the fan assembly suitable for receiving an air flow in accordance with a pressure difference; and an impeller arranged to rotate in a manner that creates the pressure difference to drive the air flow and disposed within the interior portion of the fan assembly, the impeller including a number of fan blades that are integrally formed with a shroud that extends toward leading edges of the fan blades to allow an increase in an effective height of the fan blades. The shroud and cover are separated by a radial gap. This gap is designed to be as small as possible to maximize the impedance to air flow through the radial gap from the relatively high pressure zone proximate to the blades to the relatively low pressure zone proximate to the fan inlet.

According to a further embodiment, a fan for an electronic device is described. The fan includes a cover. The fan also includes an impeller arranged to rotate around a center of rotation independent of the cover. The impeller includes a ring shaped shroud that cooperates with the cover to define an interior portion of the fan. The ring shaped shroud includes blades and splitter blades radially positioned around the center of rotation, each of the splitter blades having a length that is less than a length of each of the blades. At least one of splitter blades is radially positioned between every two blades.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION OF THE INVENTION

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

As computer systems are reduced in thickness, the thickness of the modules and components inside the computer systems must also be correspondingly reduced. Although these modules and components must get thinner, reduced performance is generally not an acceptable consequence and, hence, new methods are sought to improve performance of these modules. Fan modules and assemblies, in particular, can be difficult to make thinner without dramatic loss in air throughput and cooling performance.

The fans and fan systems described herein include features that can provide a thin fan profile while providing high cooling efficiency. In some embodiments, the fans include impellers with shrouds that rotate independently from stationary covers of the fans. The shrouds cooperate with the stationary covers to define interior portions of the fans. The shrouds can include blades that are fixedly coupled to the shrouds or integrally formed with the shrouds. In some embodiments, the shrouds include splitter blades, which are generally shorter than the regular blades of the fans and which can increase efficiency of the fans.

These and other embodiments are discussed below with reference to FIGS. 1-14. However, those skilled in the art will readily appreciate that the detailed description given herein with respect to these Figures is for explanatory purposes only and should not be construed as limiting.

Figure 1:
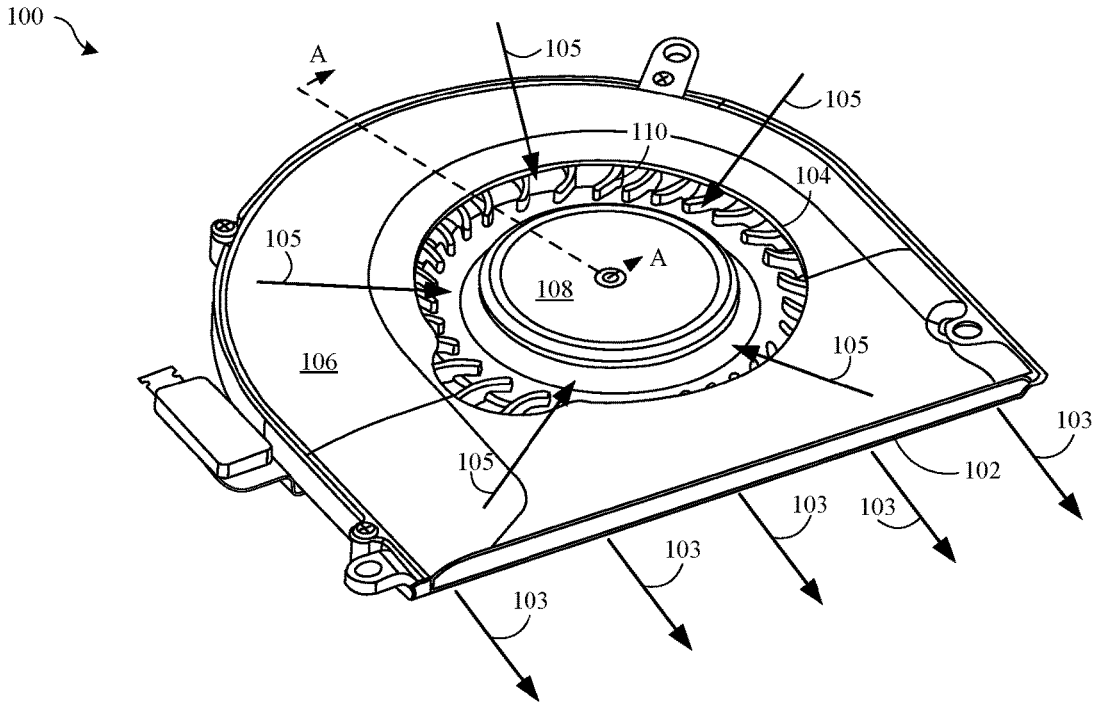
FIG. 1 (Related Art)
FIG. 1 shows a perspective view of a conventional computer fan.

FIG. 1 shows a fan 100 for which such a method would be useful. Fan 100 can have many uses. For example, fan 100 can be used in portable computing devices such as a laptop computer or other portable computing devices having limited internal volumes due to external size constraints. It should be noted that while a centrifugal fan is utilized for exemplary purposes, it should be understood that the described embodiments could be applied to both axial and mixed flow fans. Fan 100 can include exhaust opening 102 for expelling exhaust air flow 103 to an external environment and inlet opening 104 for receiving inlet air flow 105. It should be noted that, in general, inlet air flow 105 and outlet air flow 103 are generally about the same. Also depicted are cover 106 and impeller 108. Impeller 108 can be rotationally coupled to a bearing (not shown) within cover 106 that can impart a rotational force to impeller 108 causing blades 110 to rotate in such a way as to convert inlet air flow 105 into exhaust air flow 103.

Figure 2:
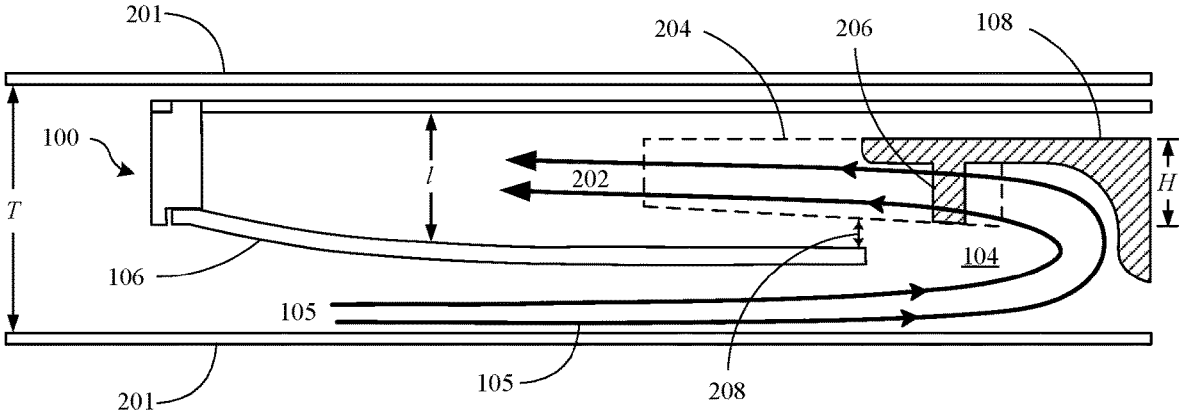
FIG. 2 (Related Art)
FIG. 2 shows a partial cross-sectional view of the conventional computer fan of FIG. 1.

FIG. 2 shows a partial cross-sectional view of fan 100 (as indicated by section line A-A of FIG. 1) that is installed within enclosure 201. More specifically, impeller 108 is depicted bringing a stream of cooling air 202 through opening 104. Fan blade 204 is depicted with dashed lines as only a portion 206 of fan blade 204 extending from impeller 108 is contained within the depicted cross-section. Each of fan blades 204 can have a curved geometry, as is depicted in FIG. 1. Inlet air flow 105 is constrained by enclosure 201, which leads to a loss of flow rate of air through fan 100. One way to attempt to increase the flow rate of air through fan 100 is to increase the height H of fan blades 204 within fan 100 without increasing the thickness l of fan 100. A consequence of increasing the blade height H in this manner is a reduction in blade/cover clearance 208 as shown in FIG. 2. Unfortunately, this clearance reduction increases the risk of fan blades 204 interfering and/or causing rubbing noise between fan blades 204 and cover 106.

It may also be desirable to improve a number of other performance parameters of fan 100, especially when factors such as fan noise and thermal performance are important. Two such performance parameters include a volumetric flow rate of air through fan 100, and an acoustic output (otherwise referred to as fan noise) of the fan 100 under operating conditions. In applications noted above where fan 100 is anticipated for use in a laptop computer environment, it can be of particular importance that fan 100 remove as much heat as possible with as little fan noise as possible in keeping with a desired computer user's experience. For example, if a thickness T of the computer system surrounding fan 100 and a thickness l of fan 100 are reduced in such a way that the ratio of fan thickness to computer system thickness (l/T) remains constant, the change in air flow performance of fan 100 can be calculated using known scaling equations, such as scaling equations found in Chadha, Raman (2005), Design of High Efficiency Blowers for Future Aerosol Applications, M.S. Thesis, Texas A&M University, College Station, Tex., USA, which is incorporated herein by reference in its entirety. In particular, using scaling equation 36 of Chadha, Raman (2005), a fan having a thickness l of 6.0 mm would be expected to deliver 71.1% of the volumetric flow rate that of a fan having a thickness l of 8.0 mm. That is, the volumetric flow rate is significantly reduced by such thickness change. The static pressure is less sensitive to thickness changes. Specifically, a fan having a thickness l of 6.0 mm is calculated to produce 99.0% of the static pressure compared to a fan having a thickness l of 8.0 mm.

Figure 3:
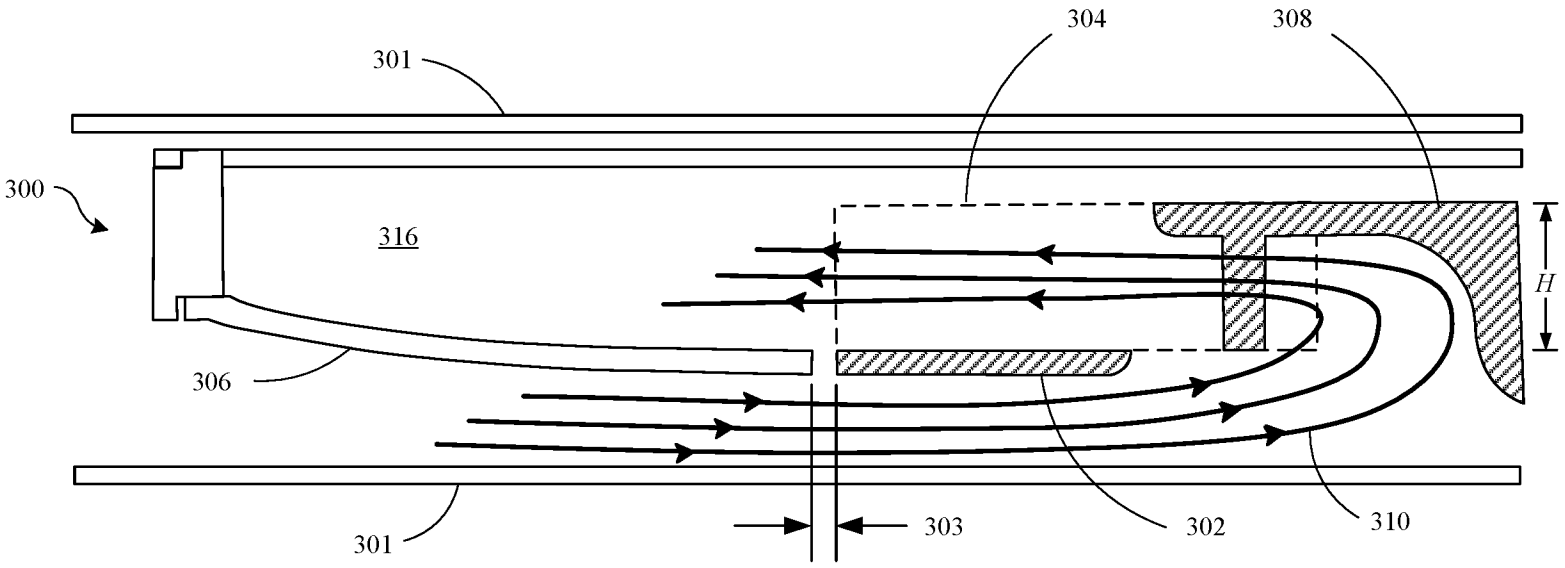
FIG. 3 shows a way of increasing a height of the fan blades without increasing an overall height of the fan.

The fan and fan assemblies described herein are thin such that they can be positioned within small spaces such as enclosures of laptops and other portable computing devices, yet can deliver exceptional cooling needed for modern high performance computer systems. The fans include fan blades that are incorporated with or attached to a shroud. The shroud can function as a portion of the cover of the fan, thereby providing a configuration that allows for an increased fan blade area compared to conventional fans. To illustrate, FIG. 3 shows a cross-sectional view of a fan 300 in accordance with some embodiments. Fan 300 is positioned within enclosure 301, which can correspond to an enclosure for a computer system or an enclosure of a subsystem that is further encased within one or more enclosures of a computer system. In this way, fan 300 and enclosure 301 form a fan assembly. Fan blade 304 is represented with dashed lines since the cross-section view of FIG. 3 shows a portion of impeller 308 that does not include fan blade 304. Fan blade 304 is one of multiple fan blades that are not depicted in FIG. 3. Fan blade 304 is coupled with shroud 302 such that shroud 302 can rotate with fan blade 304 and independent of cover 306. Shroud 302 can be located proximate to and separated from cover 306 by shroud/cover radial gap 303. Pathlines 310 indicate air flow between enclosure 301 and fan 300, and toward interior portion 316 of fan 300. Shroud 302 can function as a portion of cover 306 in that shroud can physically prevent ingress of air flow into an interior of fan 300 other than as depicted by pathlines 310.

It should be noted that fan 300 shows a particular technique for increasing blade height H compared to fan 100 of FIG. 2 without decreasing a blade/cover clearance. That is, incorporating shroud 302 with blade 304 allows blade 304 to be taller compared to a blade height that would be possible if a stationary cover is used, such as fan 100 of FIG. 2. This increases the effective height of blade 304, which corresponds to the height of the blade 304 that is effective in moving air. In addition, this configuration eliminates the need for a clearance between fan blade 304 and the portion of the cover that makes up shroud 302. The extra blade height H (corresponding to increased blade area) afforded by shroud 302 allows more momentum to be imparted to the incoming air, which can result in the development of higher static pressures and increased flow rates. The blade height inboard of shroud 302 can also be increased, resulting in additional useful blade surface.

Figure 4:
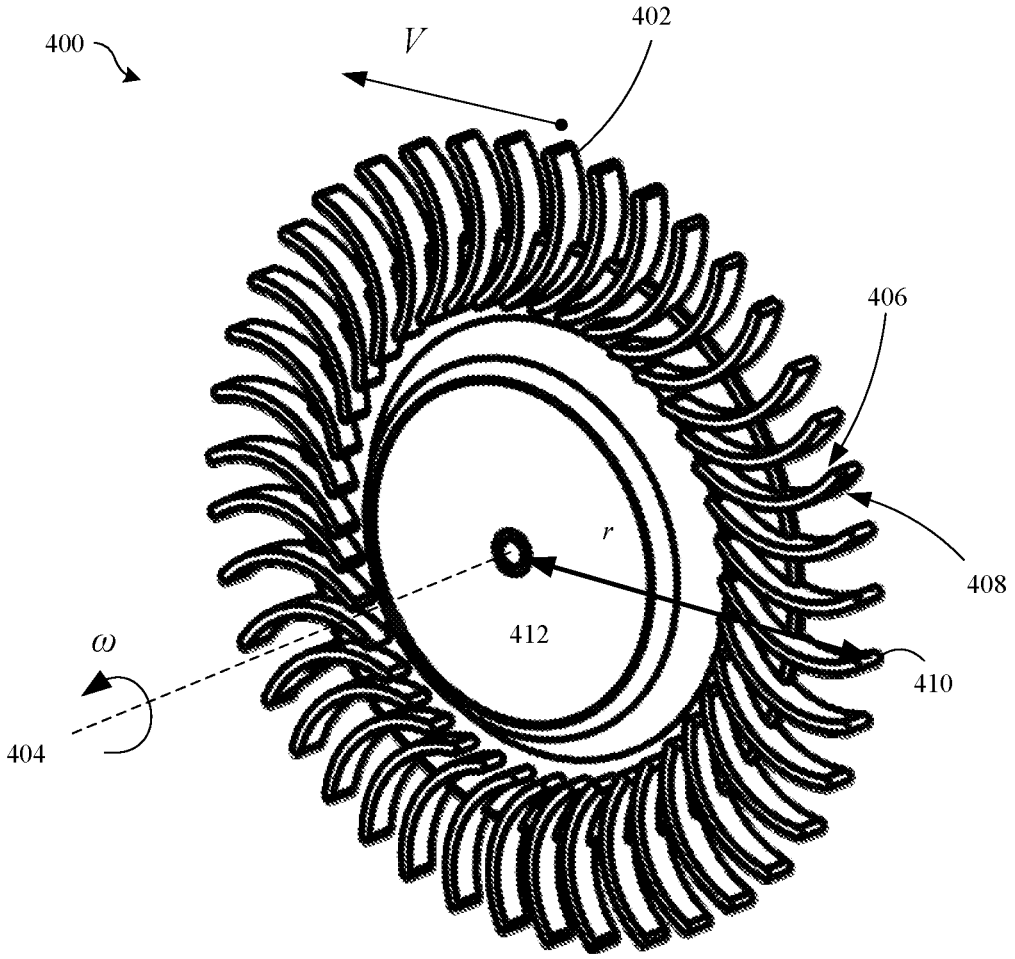
FIG. 4 shows a figure defining the "pressure" and "suction" sides of a centrifugal impeller fan blade.

In some embodiments it may be beneficial to avoid having shroud 302 extend all the way to the blade tips, as shown in FIG. 3. This is because this configuration could result in shroud/cover radial gap 303 being located at a region where the pressure difference between the inside and outside of the fan would be at its highest. In some configurations, shroud/cover radial gap 303 can be on the order of between about 0.3 mm and 0.5 mm wide. Alternatively, to ensure a properly functioning shrouded impeller, the ratio of shroud/inlet radial gap (g) to impeller blade tip diameter (D) should be less than 0.01. That is, $g/D<0.01$. This is because the pressure can increase significantly with distance from a rotational axis of the impeller due to the action of the fan blade 304 being rotated through the air. This is illustrated at FIG. 4, which shows an isometric view of impeller 400. Impeller 400 includes a central portion or central hub 412, and fan blades that extend radially from central hub 412. V represents the air velocity as experienced by fan blades 402, r represents the distance from rotational axis 404 of the impeller 400 to tips 410 fan blades 402, and ω represents the rotational speed of impeller 400. The pressure increases significantly with distance r from the rotational axis due to the action of the fan blades 402 being rotated through air. Rotation of impeller causes higher static pressure to develop in "pressure side" 406 compared to "suction side" 408 of fan blades 402. This results in creating different pressure gradients within a fan.

Figure 5:
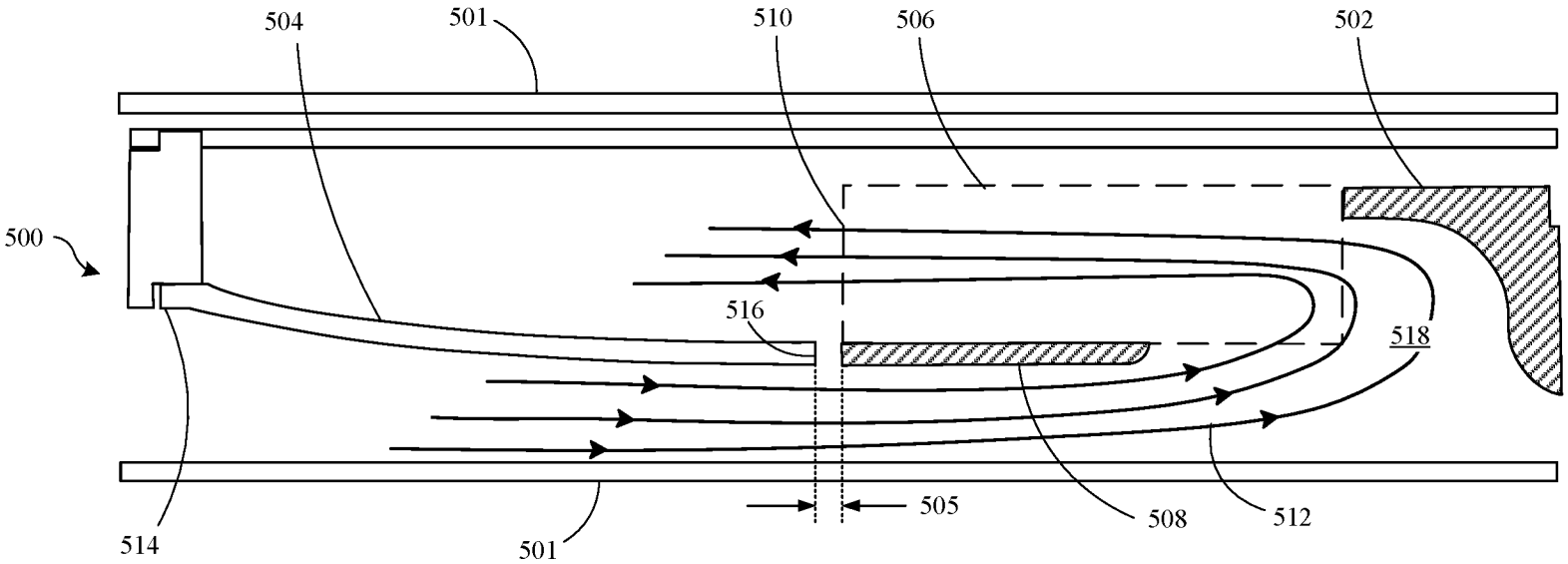
FIG. 5 shows a cross-sectional view of a fan and a flow pathlines associated with that fan.

FIG. 5 shows a cross-section partial view of fan 500 positioned within enclosure 501 illustrating how different pressure differentials can be formed. Fan 500 includes impeller 502 and cover 504. Impeller 502 includes blades 506 and shroud 508, with shroud 508 extending to tips 510 of blades 506. Air flow into fan 500 is represented by pathlines 512. Fan inlet zone 518 corresponds to a region external to fan 500 where air enters the fan 500. Air pressure gradually decreases as air flows from outer edge 514 to inner edge 516 of cover 504. Then, air pressure gradually increases as air flows from fan inlet zone 518 to tips 510 of blades 506. The region of blades 506 immediately proximal to shroud/cover radial gap 505 experiences the highest static pressure. In particular, region of blades 506 immediately proximal to shroud/cover radial gap 505 experiences much higher static pressure compared to fan inlet zone 518. This significant difference in static pressure is separated by only shroud/cover radial gap 505.

Providing some amount of radial overlap between fan blades 506 and cover 504 can reduce this pressure difference. The reduced pressure difference results in a lower likelihood of recirculating air from fan blades 506 back out into the fan inlet zone 518. The compromise required by this solution is the need to maintain a blade-cover axial clearance outboard of shroud 508, which results in less available blade area for moving air when compared to an impeller that has shroud 508 that extends to tips 510 of blades 506. In some embodiments, shroud 508 can extend across a bottom surface of cover 504 in more traditional configurations.

Figure 6:
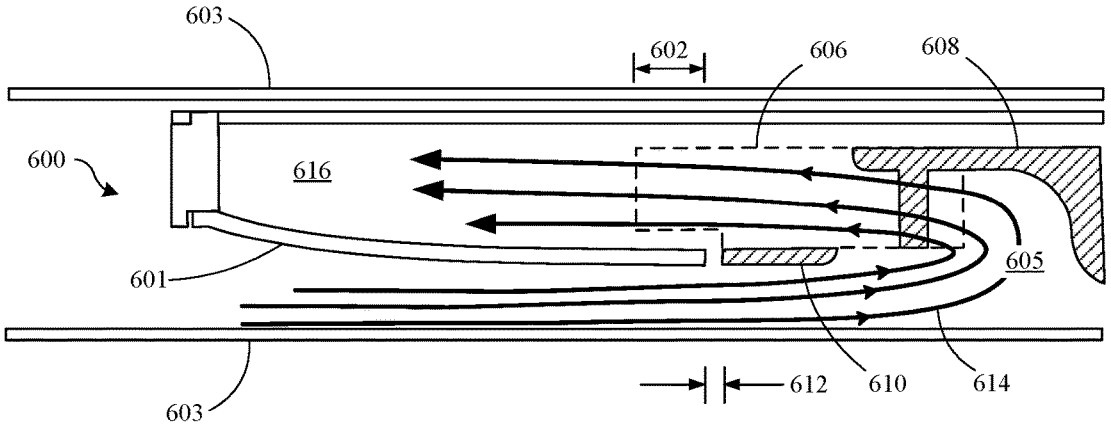
FIG. 6 shows a partial cross-sectional view of another fan in which some blade-cover overlap is implemented.
Figure 7:
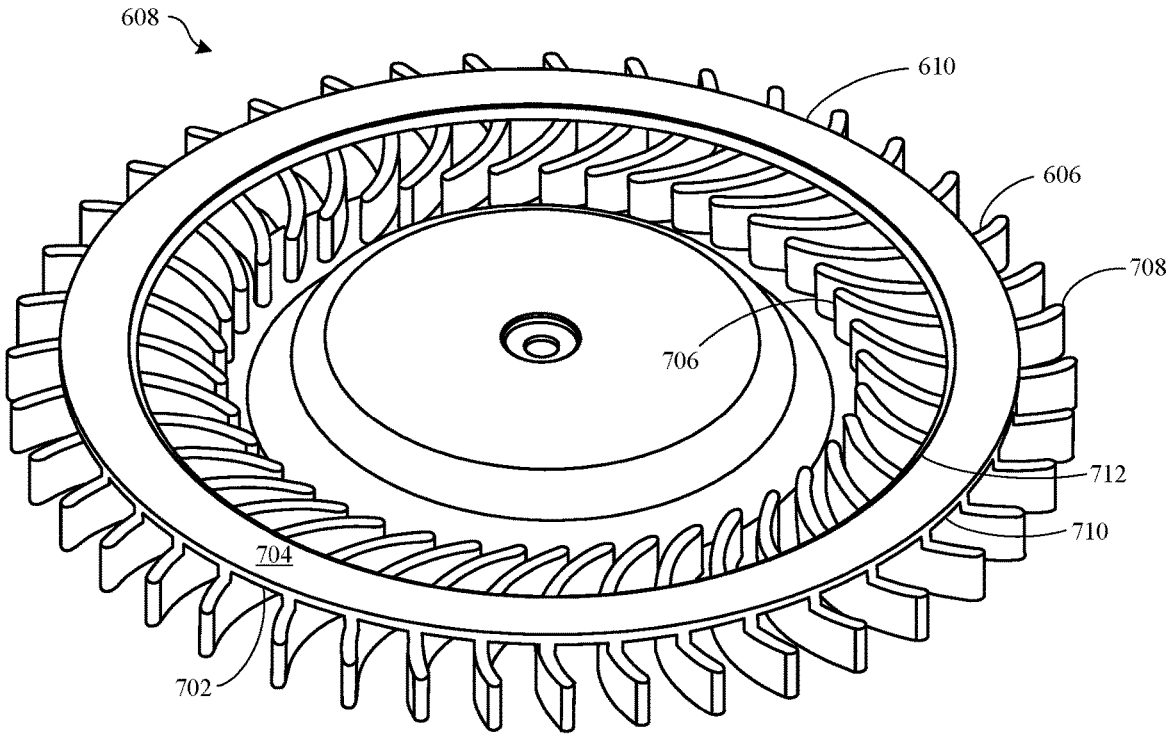
FIG. 7 shows an isometric view of the impeller of FIG. 6.

An example of an impeller that is shrouded and yet maintains some blade-cover overlap is shown in FIG. 6, which shows a partial cross-section view of fan 600 within enclosure 603. Fan 600 includes impeller 608 and cover 601. Shroud/cover radial gap 612 separates cover 601 and shroud 610. Pathlines 614 indicate air flow between enclosure 603 and fan 600, and toward interior portion 616 of fan 600. An isometric view of the impeller 608 is shown in FIG. 7. As shown in embodiments of FIGS. 6 and 7, shroud 610 can be positioned relative to fan blades 606 such that portions of fan blades 606 overlap with cover 601 (indicated by overlap 602), which reduces a likelihood of recirculating air from fan blades 606 into fan inlet zone 605. FIG. 7 shows how shroud 610 can have a ring or disc shape that can be characterized as having a first side 702 and opposing second side 704. Fan blades 606 each have a leading edge 706 and trailing edge 708. Fan blades 606 can be circularly arranged with respect to shroud 610 such that leading edges 706 define a leading edge diameter and the trailing edges 708 define a trailing edge diameter. Fan blades can be positioned on first side 702 positioned, while second side 704 can correspond to a surface of shroud 610 that cooperates with cover 601 to prevent ingress of air into an interior of the fan until it reaches the fan inlet opening.

In some embodiments, shroud 610 is positioned at a central portion of fan blades 606 corresponding to a portion of fan blades 606 between leading edges 702 and trailing edges 704. For example, shroud 610 can be characterized as having outer edge 710 and inner edge 712. Outer edge 710 can define an outer diameter of shroud 610, and inner edge 712 can define an inner diameter of shroud 610 that acts as the fan inlet. Fan blades 606 can be arranged with respect to the shroud such that the trailing edge diameter (corresponding to trailing edges 708) is larger than the outer diameter of shroud 610 (corresponding to outer edge 710). In some embodiments, the leading edge diameter (corresponding to leading edges 706) is smaller than the inner diameter of shroud 610 (corresponding to inner edge 712).

Figure 8A:
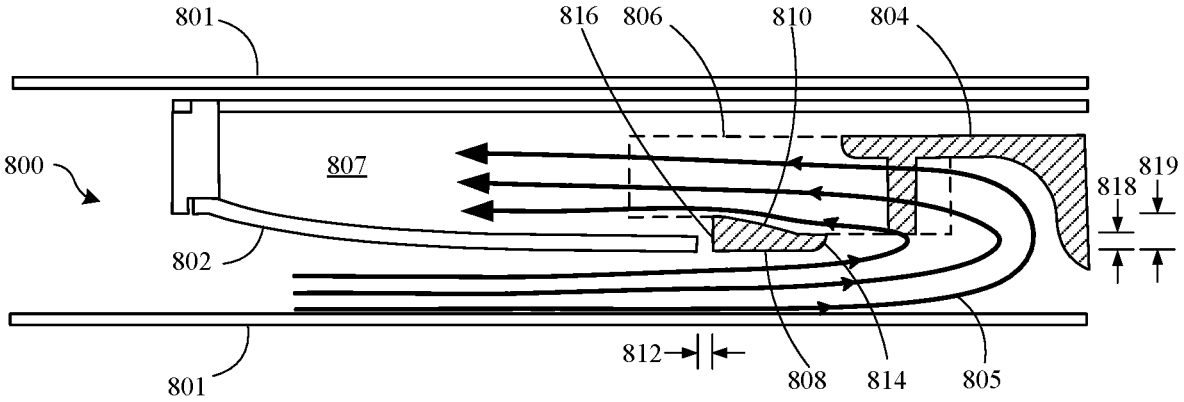
FIGS. 8A-8E show alternative embodiments in which a shroud ring has a curved shroud surface that guides air flow away from recirculating through a shroud/cover radial gap.

FIGS. 8A-8E show alternative embodiments in which a shroud and/or a cover are designed to prevent air flow within a shroud/cover radial gap, thereby improving the efficiency of the fan. FIG. 8A shows a cross section view of fan 800 positioned within enclosure 801. Fan 800 includes cover 802 and impeller 804. Impeller 804 includes blades 806 and shroud 808. Pathlines 805 indicate air flow between enclosure 801 and fan 800, and toward interior portion 807 of fan 800. Shroud 808 is separated from cover 802 by shroud/cover radial gap 812. Shroud 808 includes outlet surface 810 that is tapered to guide air flow (indicated by pathlines 805) away from shroud/cover radial gap 812 preventing recirculating of air through shroud/cover radial gap 812. That is, shroud outlet surface 810 is angled to impart a vertical velocity component to the air flow near shroud/cover radial gap 812, thereby biasing air flow away from shroud/cover radial gap 812. For example, shroud outlet surface 810 can be arranged to direct air flow above and away from shroud/cover radial gap 812. In some embodiments, this can be accomplished by increasing a thickness of shroud 808 when traveling from inner edge 814 to outer edge 816 of shroud 808. Specifically, the thickness of shroud 808 increases from a first thickness 818 at inner edge 814 to a second thickness 819 at outer edge 816. In some embodiments, shroud outlet surface 810 has a straight or linear shape while in other embodiments shroud outlet surface 810 is curved. In some embodiments, shroud outlet surface 810 includes one or more steps that provide a desired amount of taper. In some embodiments, shroud outlet surface 810 has a combination of linear segments, curved segments and/or stepped segments.

Figure 8B:
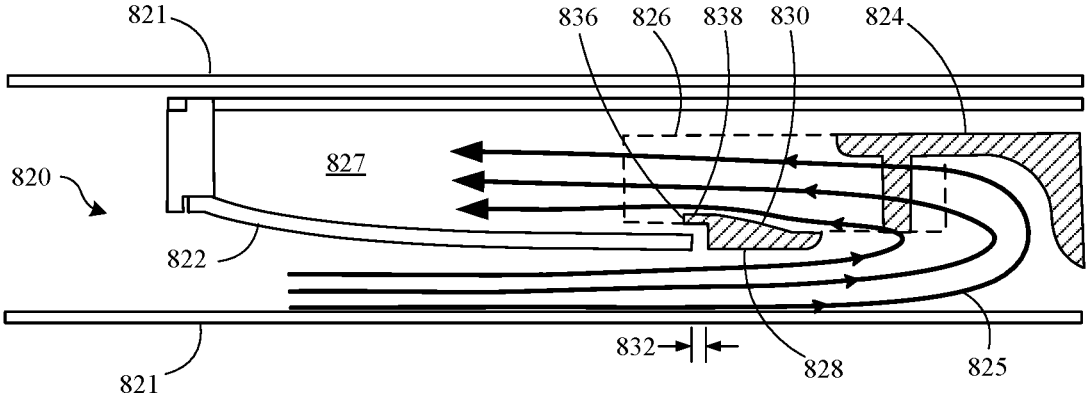

FIG. 8B shows fan 820 having another alternative configuration in accordance with described embodiments. Fan 820 includes cover 822 and impeller 824. Impeller 824 includes blades 826 and shroud 828. Pathlines 825 indicate air flow between enclosure 821 and fan 820, and toward interior portion 827 of fan 820. Shroud 828 is separated from cover 822 by shroud/cover radial gap 832. Shroud 828, in addition to having a tapered shroud outlet surface 830, also includes an overlapping feature 838 that overlaps with cover 822 proximate shroud/cover radial gap 832. Overlapping feature 838 can force air out of shroud/cover radial gap 832 and back toward interior portion 827 of fan 820. This can prevent undesirable leakage of air through radial gap 832. Overlapping feature 838 can correspond to a ledge or lip positioned at inner edge 836 of shroud 828.

Figure 8C:
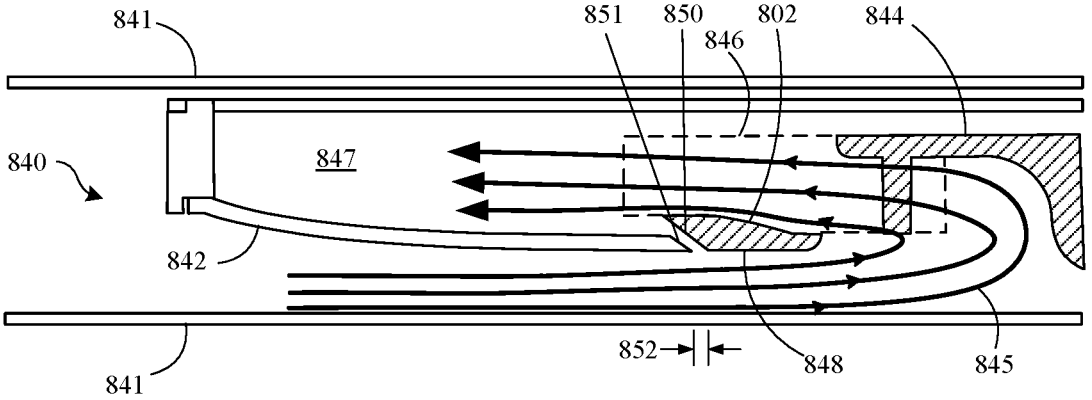

FIG. 8C shows fan 840 having another configuration in accordance with described embodiments. Fan 840 includes cover 842 and impeller 844. Impeller 844 includes blades 846 and shroud 848. Pathlines 845 indicate air flow between enclosure 841 and fan 840, and toward interior portion 847 of fan 840. Fan 840 is configured such that surfaces defining shroud/cover radial gap 852 are slanted in a way to prevent air flow into shroud/cover radial gap 852. Specifically, outer edge 850 of shroud 848 and surface 851 of cover 842 define a shroud/cover radial gap 852 having a diagonal geometry that is slanted in a direction different than the air flow into the fan (represented by pathlines 845). This diagonal configuration forces air out of shroud/cover radial gap 852 and back toward interior portion 847 of fan 840, which as in fan 820 of FIG. 8B reduces a likelihood of a parasitic flow path from being established through shroud/cover radial gap 852.

Figure 8D:
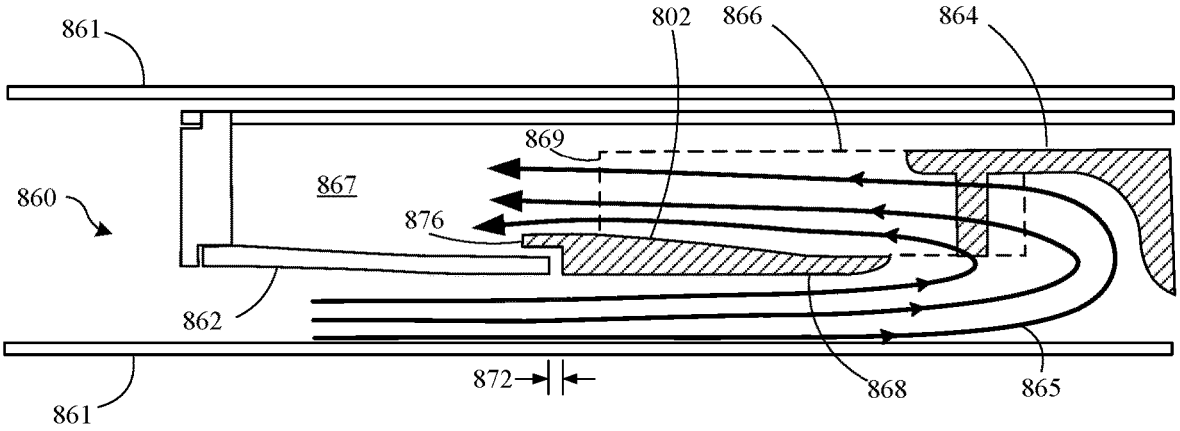

FIG. 8D shows fan 860 having another configuration in accordance with described embodiments. Fan 860 includes cover 862 and impeller 864. Impeller 864 includes blades 866 and shroud 868. Pathlines 865 indicate air flow between enclosure 861 and fan 860, and toward interior portion 867 of fan 860. Fan 860 shows a configuration in which outer edge 876 of shroud 868 extends past trailing edges 869 of fan blades 866. This configuration prevents high pressure air exiting fan blades 866 and entering interior portion 867 from recirculating through shroud/cover radial gap 872. In some cases this configuration adds more length to shroud 868 compared to the shrouds shown in FIGS. 8A-8C.

Figure 8E:
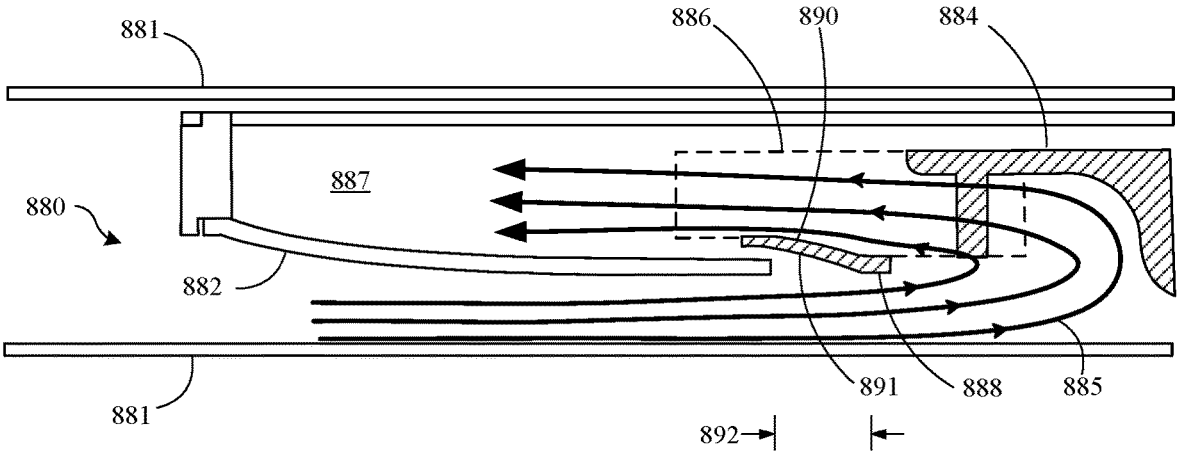

FIG. 8E shows fan 880 having another alternative configuration in accordance with described embodiments. Fan 880 includes cover 882 and impeller 884. Impeller 884 includes blades 886 and shroud 888. Pathlines 885 indicate air flow between enclosure 881 and fan 880, and toward interior portion 887 of fan 880. Fan 880 shows a configuration in which shroud 888 has a tapered shroud interior surface 890 and a tapered shroud exterior surface 891. One or both of tapered shroud interior surface 890 and a tapered shroud exterior surface 891 can have a linear shape, curved shape, stepped shape, or a combination of linear, curved and/or stepped segments. The tapered shroud exterior surface 891 directs air away from the shroud/cover radial gap 892 on one side of shroud 888, and curved shroud interior surface 890 directs air that has a tendency to recirculate within interior portion 887 away from shroud/cover radial gap 892 on another side of shroud 888.

Note that any suitable combination of the shroud and cover configurations described above with reference to FIGS. 8A-8E can be utilized. For example, the shrouds can have any suitable combination of the above-described varying thicknesses, tapered shroud outlet surfaces, tapered shroud inlet surfaces, slanted outer edges, overlapping features and outer edges that extend past trailing edge of the blades.

Figure 9:
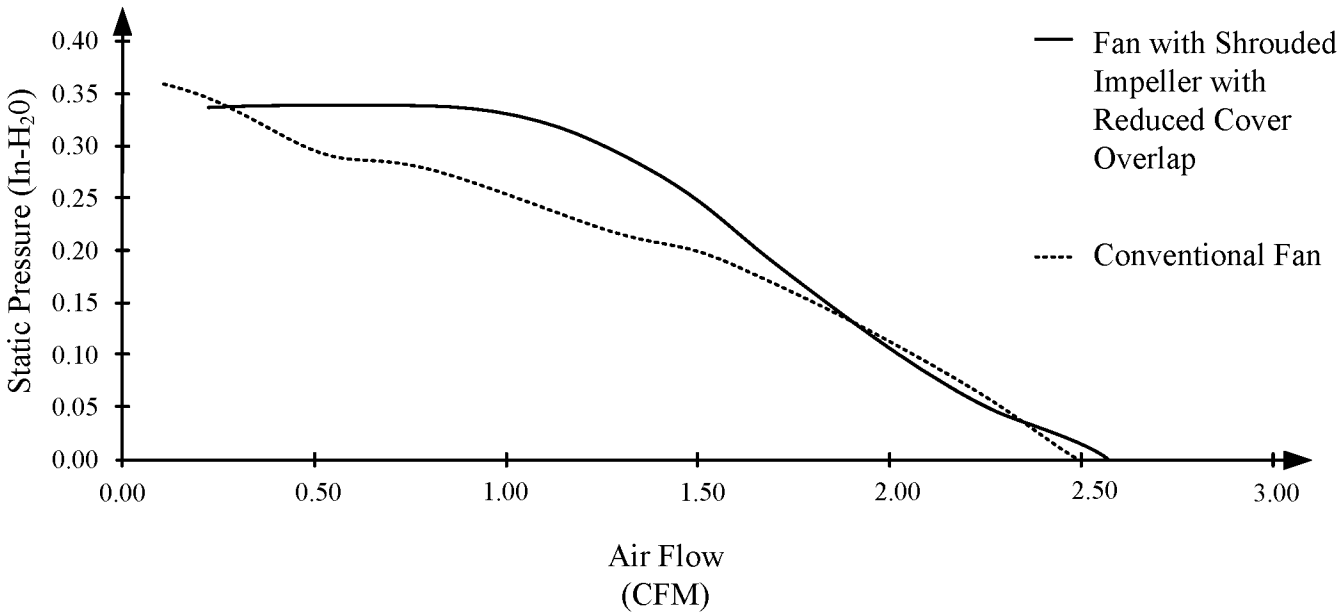
FIG. 9 shows a graph depicting both air flow performance characteristics with and without a shrouded impeller.

FIG. 9 shows a graph depicting both air flow performance of a fan using a shrouded impeller, such as the one shown in FIG. 7 and performance of an unshrouded, or conventional, impeller such as the one used in the fan of prior art FIG. 1. The solid line shows the fan curve of a shrouded impeller with similar overall geometry and fan speed, but with a shroud. A large increase in the air flow delivered is observed for a significant portion of the fan operating range. The dotted line shows an example of a conventional impeller. As depicted, the shrouded impeller can have various effects on fan performance and can be beneficial for certain air flow rates and static pressures.

Figure 10:
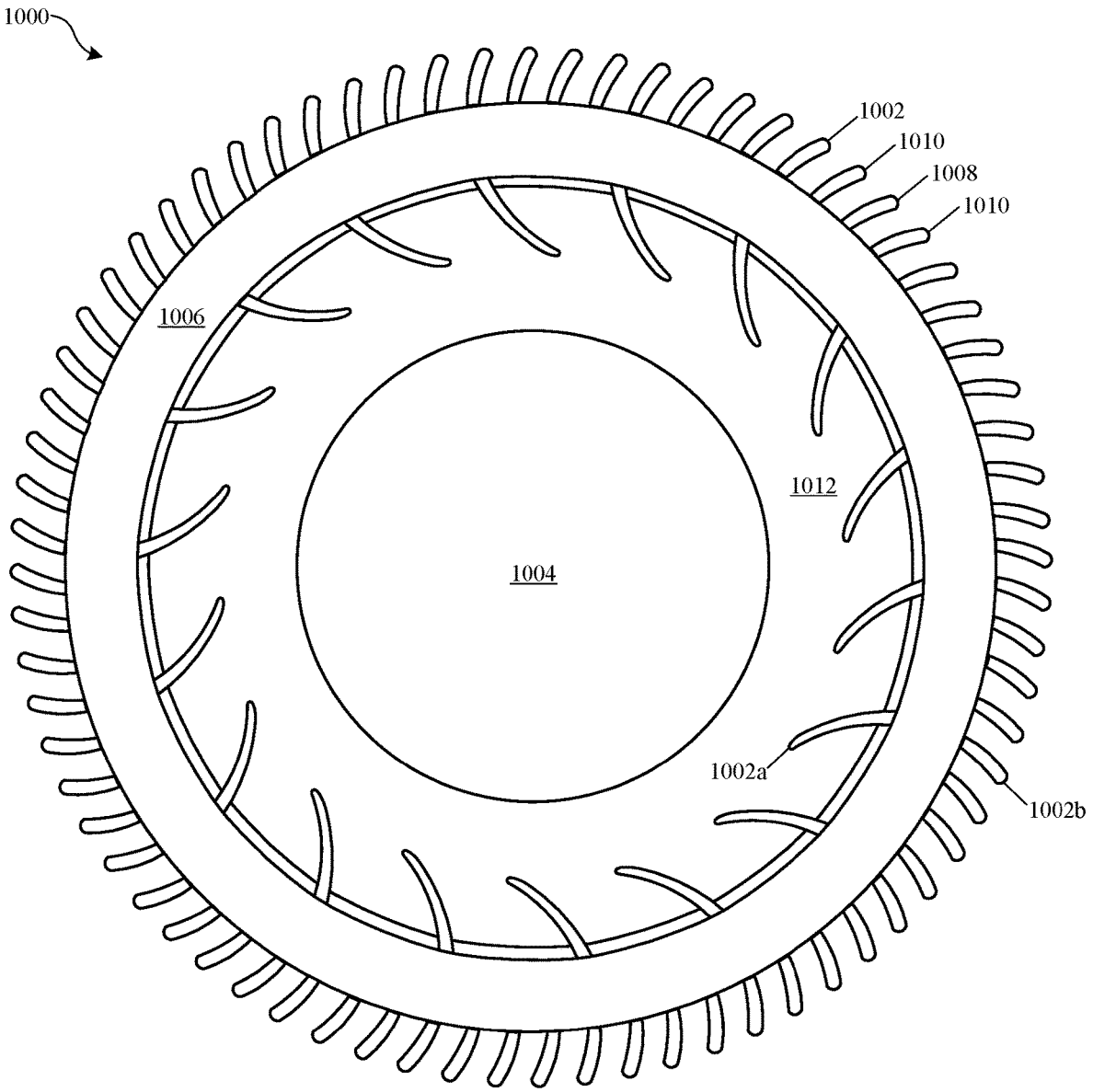
FIGS. 10 and 11 show a front view of an impeller with shroud that includes splitter blades.

In some embodiments, the fan includes splitter blades that can be coupled to the shroud or other portions of the impeller in order to increase the efficiency of the fan. FIG. 10 shows a front view of impeller 1000, which includes a number of blades 1002 radially positioned around an axis of rotation of impeller 1000. Central portion 1004 covers an impeller motor and bearing when impeller 1000 is assembled within a fan. Blades 1002 can have any suitable shape, including curved geometries that can be curved into the direction of rotation. Each of blades 1002 includes leading edges 1002*a* that are positioned more proximate to the center of rotation than trailing edges or tips 1002*b*. In some embodiments, impeller 1000 includes blade support disc 1012 that is coupled with and supports leading edges 1002*a* of blades 1002. The center of blade support disc 1012 can correspond to a center of rotation of impeller 1000.

Impeller 1000 includes shroud ring 1006 that can constitute part of a cover and reduce the overall height of a fan, as described above. Shroud ring 1006 can be rigidly coupled with and support blades 1002, or formed integrally with blades 1002. In this way, shroud ring 1006 can rotate with blades 1002 during fan operation. In addition to blades 1002, impeller 1000 includes splitter blades 1008/1010, which are also radially positioned around an axis of rotation. In some embodiments, splitter blades 1008/1010 are coupled with shroud ring 1006. Like blades 1002, splitter blades 1008/1010 can guide air flow when impeller 1000 is rotated. However, splitter blades are generally shorter in length than blades 1002 and can thus be referred to as partial blades. The shorter length of splitter blades 1008/1010 allows for optimized flow guidance in the channels formed between adjacent blades 1002.

Figure 11:
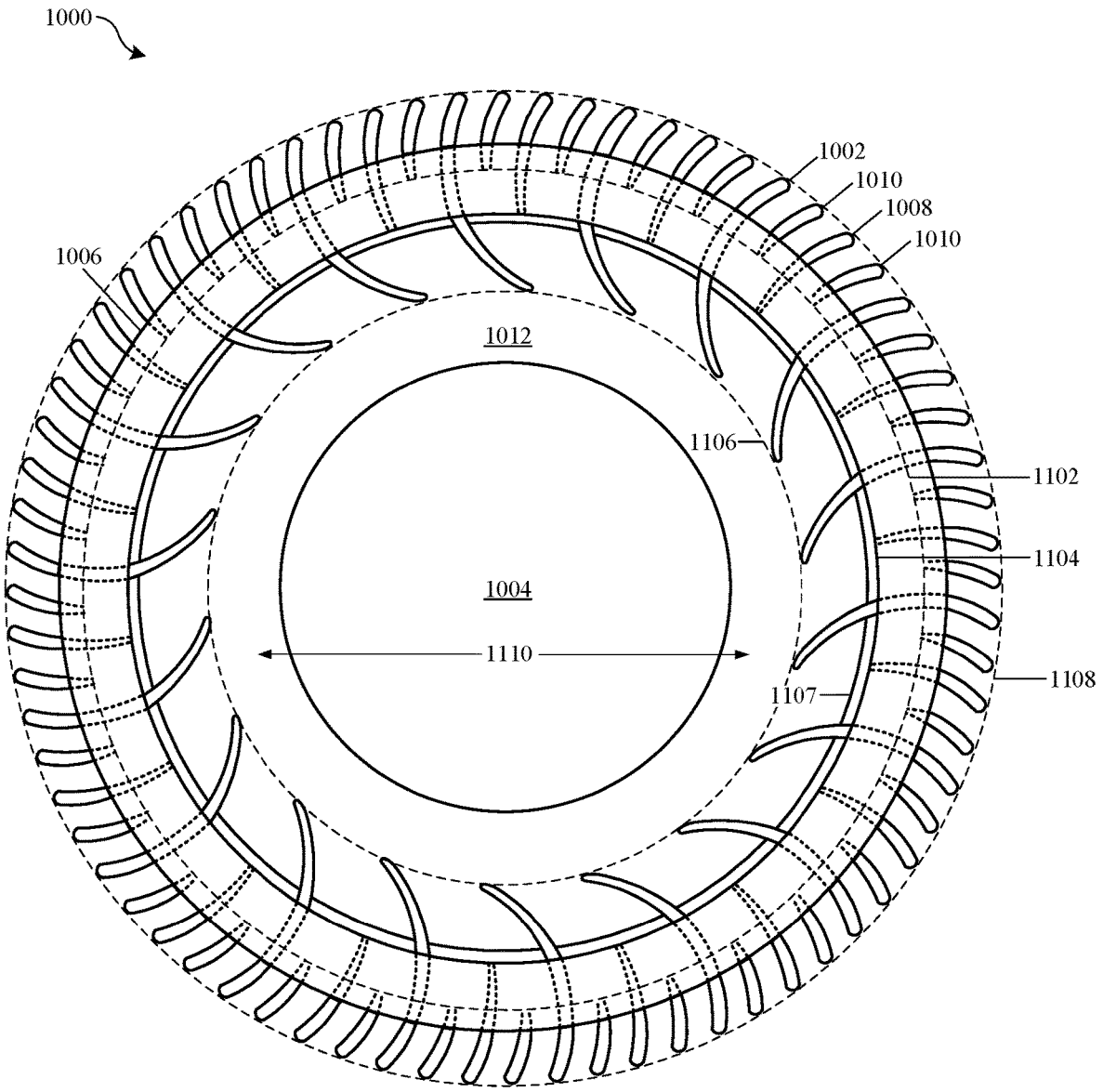

To illustrate, FIG. 11 shows a view of impeller 1000 with dashed lines representing portions of blades 1002 and splitter blades 1008/1010 that are not visible from a front view. Blades 1002 and splitter blades 1008/1010 each have trailing edges that are defined by fan blade diameter 1108. However, splitter blades 1008/1010 have different lengths than blades 1002. In particular, the leading edges of splitter blades 1010 are defined by a first diameter 1102, the leading edges of splitter blades 1008 are defined by a second diameter 1104, and the leading edges of blades 1002 are defined by a third diameter 1106. The shorter lengths of splitter blades 1008/1010 keep them from impeding air flow entering from interior region 1110. At the same time, the additional trailing edges or tips of splitter blades 1008/1010 being positioned along the fan blade circumference corresponding to diameter 1108 allows for improved guidance of air into the fan compared to blades 1002 alone. This can be important since the guidance provided by the tips of blades 1002 and splitter blades 1008/1010 are critical in determining the amount of air pressure produced by impeller 1000. In some embodiments, the leading edges of one or both of splitter blades 1008 and splitter blades 1010 do not overlap with blade support disc 1012. That is, one or both of diameters 1102 and 1104 can be larger than a diameter defined by an outer edge 1107 of blade support disc 1012.

Figure 12:
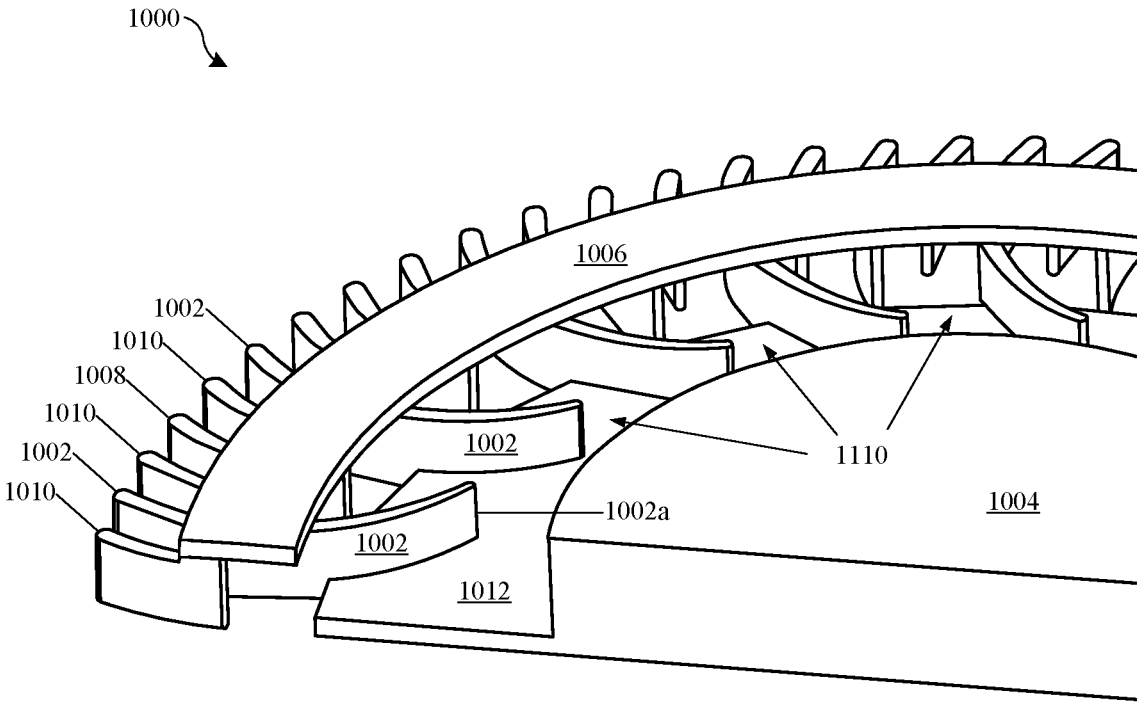
FIGS. 12 and 13 show isometric views of portions of the impeller of FIGS. 10 and 11.
Figure 13:
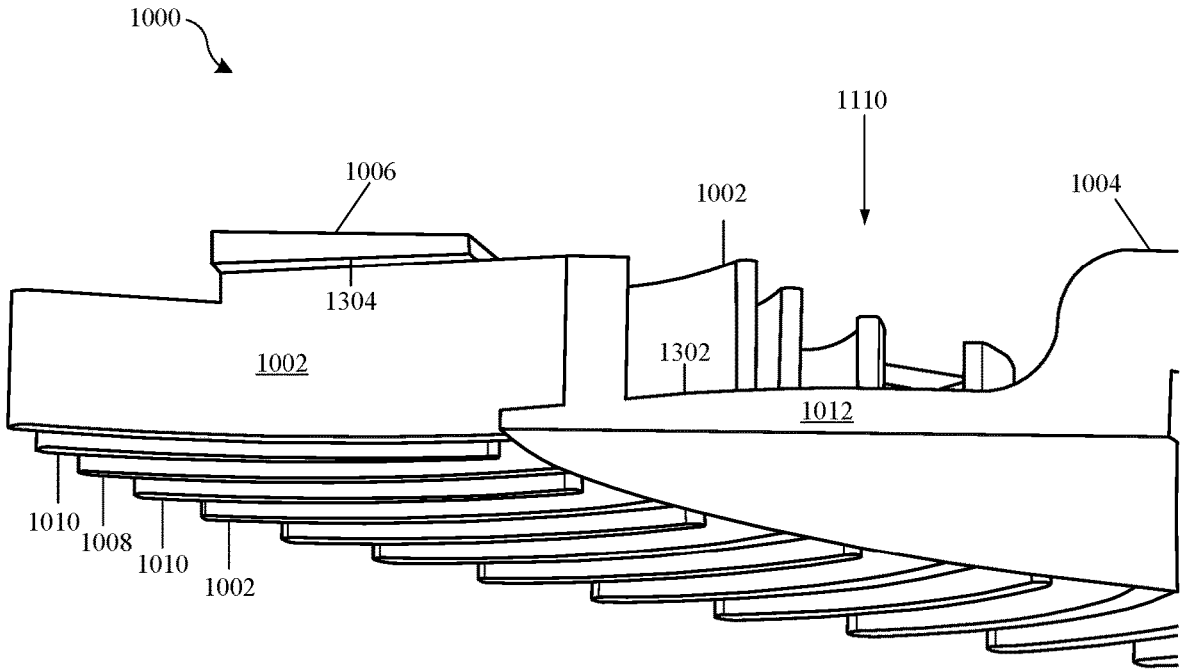

FIGS. 12 and 13 show isometric section views of a portion of impeller 1000 showing additional details of blades 1002 and splitter blades 1008/1010. As shown, blades 1002 and splitter blades 1008/1010 are coupled with shroud ring 1006. A top surface of shroud ring 1006 can correspond to a portion of a cover that impeller 1000 is assembled in. Blade support disc 1012 is positioned below shroud ring 1006 and is coupled with the leading edges of blades 1002, which provides additional structural support for the longer length of blades 1002. In some embodiments support disc 1012 has a tapered shape such that surface 1302 of support disc 1012 is substantially parallel or divergent with respect to surface 1304 of shroud ring 1006. Splitter blades 1008/1010 are shorter than blades 1002 and circumferentially positioned between blades 1002. The shorter length of splitter blades 1008/1010 provides improved flow guidance within interior region 1110 of impeller 1000, thereby providing more efficient air flow through impeller 1000.

Note that since shroud ring 1006 supports splitter blades 1008/1010, splitter blades 1008/1010 do not need to extend from a location closer to the center of rotation, thereby allowing splitter blades 1008/1010 to be shorter and thus reduce impedance of air into the channel between consecutive blades 1002. In embodiments that do not include shroud ring 1006, splitter blades 1008/1010 can be coupled with support disc 1012. In these embodiments, support disc 1012 can include gaps between splitter blades 1008/1010 to allow for low-impedance air flow within interior region 1110. However, removal of shroud ring 1006 may mean losing some extra blade height afforded by the addition of shroud ring 1006, as describe above with reference to FIG. 3. In addition, there can be some loss of blade area near support disc 1012.

Impeller 1000 shown in FIGS. 10-13 is configured such that two shorter splitter blades 1010 and one longer splitter blade 1008 are positioned between blades 1002 (i.e., short-long-short). It should be noted that this configuration is exemplary and other configurations can be used. For example, in some embodiments, an impeller can include splitter blades that each has one length, or the impeller can include splitter blades having more than two different lengths. In some embodiments, the splitter blades are arranged in other orders, such as long-short-long, short-short-long, long-long-short, long-medium-short, etc. In some embodiments, there is one splitter blade between each blade 1002, while in other embodiments there are two, three, four, or more splitter blades between each blade 1002. That is, the number and order of splitter blades can vary depending on design choice. Generally, the larger the fan blade diameter 1108 is, the more blades 1002 and splitter blades 1008/1010 can be positioned within the impeller to optimize air flow. The optimal number, order and shape of blades and splitter blades can be calculated for a given impeller by considering parameters such as the fan blade diameter and divergence angle between consecutive blades.

Figure 14A:
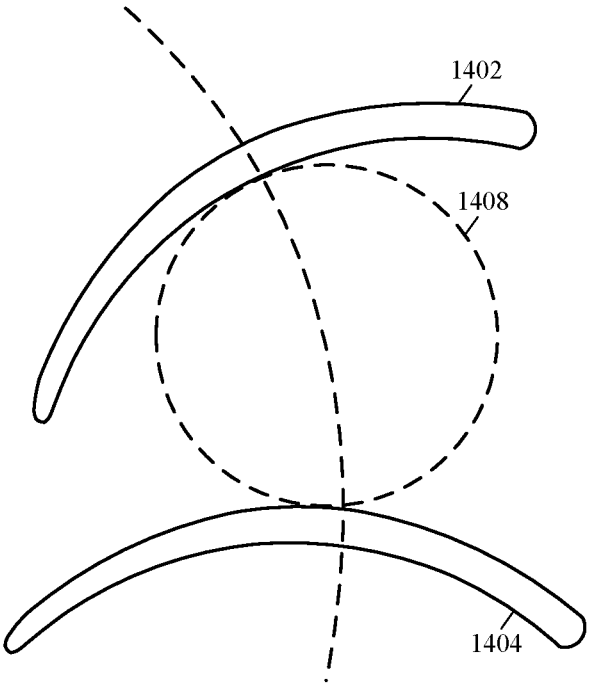
FIGS. 14A-14D illustrate how a divergence angle between blades and splitter blades can affect air flow.
Figure 14B:
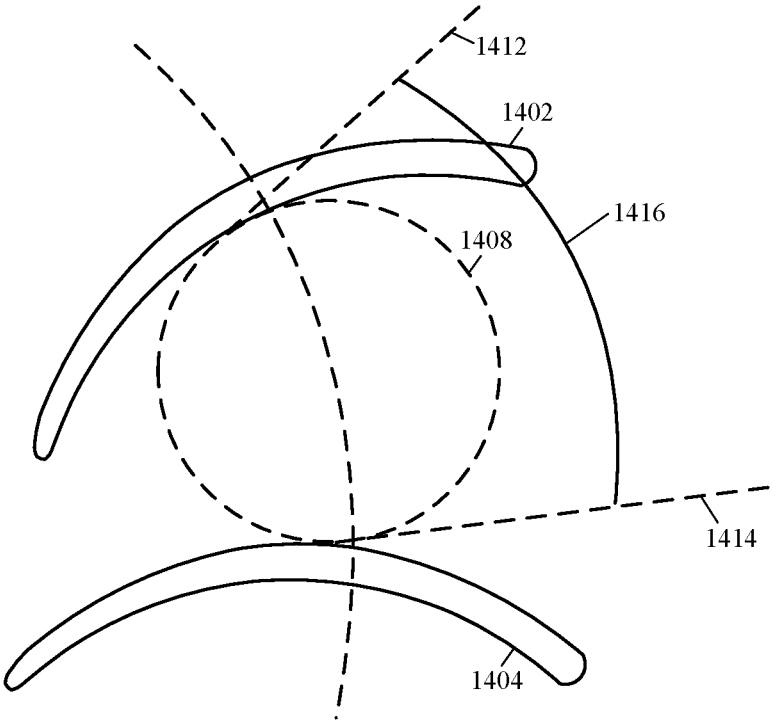
Figure 14C:
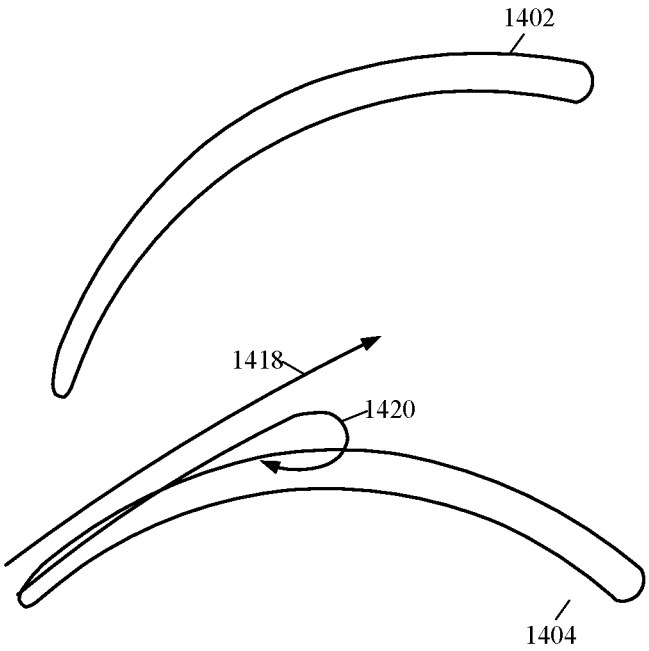

FIGS. 14A-14D illustrate how a divergence angle between blades 1402 and 1404 can affect air flow. FIG. 14A shows reference circle 1408, which is at a first radial distance from the center of rotation of the impeller. FIG. 14B shows reference lines 1412 and 1414, which are tangential to reference circle 1408. Angle 1416 corresponds to the angle between reference lines 1412 and 1414, also referred to as a divergence angle. If divergence angle 1416 is too large, the air flow between blades 1402 and 1404 becomes inefficient. This is illustrated in FIG. 14C, showing air flow pathlines 1418 and 1420 passing between blades 1402 and 1404. Pathline 1418 shows that some air passes over and follows a surface of blade 1404. However, pathline 1420 shows that some air does not follow the surface of blade 1404 but instead reverses direction, also known as flow separation. This flow separation can occur if the divergence angle 1416 between blades 1402 and 1404 is too large, which decreases the air flow efficiency of the fan.

Figure 14D:
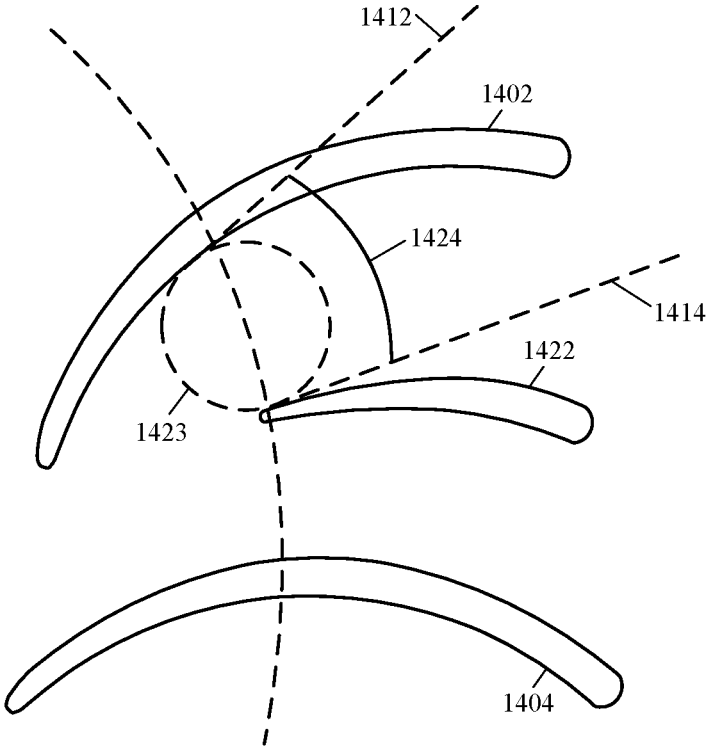

FIG. 14D shows insertion of splitter blade 1422. Reference circle 1423 is at a second radial distance from the center of rotation, which is greater than the first radial distance of reference circle 1408. Reference lines 1412 and 1414, which are tangential to circle 1408 define divergence angle 1424. As shown, divergence angle 1424 between blade 1404 and splitter blade 1422 is less than divergence angle 1416 without splitter blade 1404. The reduced divergence angle 1424 reduces or eliminates any flow separation and improves the air flow efficiency of the fan. In general, the larger the divergence angle 1416 between blades 1402 and 1404, the more splitter blades 1422 should be used. Another words, at each radial location there can be calculated an optimal number of blades. When that optimal number reaches an integer, another splitter blade can be added.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A fan comprising:

a cover having a first cover plate and a second cover plate vertically separated to define an interior fan region between the first cover plate and the second cover plate; and an impeller comprising:

a central hub, a plurality of blades extending from an interior edge of each blade coupled with the central hub to an exterior edge of each blade, wherein each blade of the plurality of blades is characterized by a first edge proximate the first cover plate and a second edge opposite the first edge, and wherein the exterior edge of each blade of the plurality of blades at least partially extends within the interior fan region, and a shroud coupled with the plurality of blades along the second edge of each blade of the plurality of blades, wherein the shroud extends radially outward to a ledge defined by each blade of the plurality of blades, and wherein each blade of the plurality of blades further extends from the ledge to the exterior edge of each blade of the plurality of blades.

2. The fan of claim 1, wherein the shroud is characterized by an interior edge and an exterior edge extending towards an outer edge of the second cover plate, wherein the exterior edge of the shroud is separated from the outer edge of the second cover plate by a gap length.

3. The fan of claim 2, wherein a ratio of the gap length to a diameter of the impeller measured to the exterior edges of the plurality of blades is less than 0.01.

4. The fan of claim 2, wherein the shroud defines a lip extending across the gap length and past an exterior edge of the second cover plate, and wherein an outer diameter of the shroud is less than an outer diameter defined by the exterior edge of the plurality of blades.

5. The fan of claim 2, wherein the shroud defines a lip extending across the gap length and past an exterior edge of the second cover plate, and wherein an outer diameter of the shroud is greater than an outer diameter defined by the exterior edge of the plurality of blades.

6. The fan of claim 1, wherein the shroud slopes from an interior edge of the shroud proximate the central hub to an exterior edge of the shroud.

7. The fan of claim 1, further comprising a plurality of splitter blades positioned about the shroud with splitter blades incorporated between sets of blades of the plurality of blades, wherein each splitter blade is characterized by a length less than a length of each blade of the plurality of blades.

8. The fan of claim 7, wherein each splitter blade of the plurality of splitter blades is characterized by an interior edge and an exterior edge, and wherein the exterior edge of each splitter blade extends to an equivalent distance of each blade of the plurality of blades.

9. The fan of claim 8, wherein the interior edge of each splitter blade extends towards the impeller to a position less than or equal to an interior edge of the shroud.

10. The fan of claim 1, wherein the central hub comprises a blade support disk coupled with a ledge defined at the interior edge of the plurality of blades in the second edge of each blade of the plurality of blades.

11. A fan assembly comprising:

a cover having a first cover plate cooperating with a second cover plate to define an interior fan region between the first cover plate and the second cover plate; and an impeller arranged to rotate about a central axis during operation, the impeller comprising:

a central hub defining an aperture along the central axis of the impeller, a plurality of blades coupled with the central hub at an interior edge of each blade of the plurality of blades opposite an exterior edge of each blade, wherein the exterior edge of each blade of the plurality of blades at least partially extends within the interior fan region, and a shroud coupled with the plurality of blades along an edge of each blade of the plurality of blades proximate the second cover plate, wherein the shroud extends radially outward to a ledge defined by each blade of the plurality of blades, and wherein each blade of the plurality of blades further extends radially outward from the ledge to the exterior edge of each blade of the plurality of blades.

12. The fan assembly of claim 11, further comprising a plurality of splitter blades positioned about the shroud with splitter blades incorporated between sets of blades of the plurality of blades, wherein each splitter blade is characterized by a length less than a length of each blade of the plurality of blades.

13. The fan assembly of claim 12, wherein each splitter blade of the plurality of splitter blades is characterized by an interior edge and an exterior edge, and wherein the exterior edge of each splitter blade extends to an equivalent distance of each blade of the plurality of blades.

14. The fan assembly of claim 13, wherein the interior edge of each splitter blade extends towards the impeller to a position less than or equal to an interior edge of the shroud.

15. The fan assembly of claim 11, wherein the central hub comprises a blade support disk coupled with a ledge defined at the interior edge of the plurality of blades.

16. A fan assembly comprising:

a cover having a first cover plate cooperating with a second cover plate to define an interior fan region between the first cover plate and the second cover plate; and an impeller comprising:

a central hub defining an aperture along a central axis of the impeller about which the impeller is configured to rotate during operation, a plurality of blades coupled with the central hub at an interior edge of each blade of the plurality of blades opposite an exterior edge of each blade, wherein the exterior edge of each blade of the plurality of blades at least partially extends within the interior fan region, and a shroud coupled with the plurality of blades along an edge of each blade of the plurality of blades proximate the second cover plate, wherein the shroud extends radially outward to a ledge defined by each blade of the plurality of blades, wherein each blade of the plurality of blades further extends radially outward from the ledge to the exterior edge of each blade of the plurality of blades, and wherein the shroud extends proximate the second cover plate to define a gap between the shroud and the second cover plate across which at least a portion of each blade of the plurality of blades extends.

17. The fan assembly of claim 16, wherein a ratio a length of the gap to a diameter of the impeller measured to the exterior edges of the plurality of blades is less than 0.01.

18. The fan assembly of claim 16, further comprising a plurality of splitter blades positioned about the shroud with splitter blades incorporated between sets of blades of the plurality of blades, wherein each splitter blade is characterized by a length less than a length of each blade of the plurality of blades.

19. The fan assembly of claim 18, wherein each splitter blade of the plurality of splitter blades is characterized by an interior edge and an exterior edge, and wherein the exterior edge of each splitter blade extends to an equivalent distance of an exterior edge of each blade of the plurality of blades.

20. The fan of claim 1, wherein each blade of the plurality of blades extends radially outward beyond a radially outer edge of the shroud.

* * * * *